United States Patent [19]

Carter et al.

[11] Patent Number: 4,685,610

[45] Date of Patent: Aug. 11, 1987

[54] CONTAINER AND METHOD OF MAKING A CONTAINER WITH INTEGRAL BOTTOM PANEL AND SIDE PANELS

[75] Inventors: Leewood C. Carter; Robin P. Neary, both of Warren, N.J.

[73] Assignee: Book Covers Inc., Newark, N.J.

[21] Appl. No.: 864,498

[22] Filed: May 19, 1986

[51] Int. Cl.[4] ..... B65V 5/35

[52] U.S. Cl. ..... 229/23 R; 229/120; 229/916; 229/DIG. 14

[58] Field of Search ..... 229/905, 916, 23 R, 229/16 R, 6 R, 43, 120, 124, 164, 165, 181, 183, 184, 45, 104, 105, 166, DIG. 14; 493/52; 206/524.2

[56] References Cited

U.S. PATENT DOCUMENTS

| | | | |
|---|---|---|---|
| 1,886,374 | 11/1932 | Breton | 229/916 |
| 1,933,869 | 11/1933 | Mosesian | 229/DIG. 14 |
| 2,389,601 | 11/1945 | De Witt | 229/23 R |
| 3,227,354 | 1/1966 | Gunyou | 229/23 R |
| 3,460,737 | 8/1969 | McCrea | 229/23 R |
| 3,481,457 | 12/1969 | Overton, III et al. | 229/23 R |
| 3,899,123 | 8/1975 | Stollberg et al. | 229/41 R |
| 3,935,943 | 2/1976 | Meyer et al. | 229/23 R |
| 4,567,996 | 2/1986 | Muise | 229/23 R |

*Primary Examiner*—Willis Little
*Attorney, Agent, or Firm*—Ezra Sutton

[57] ABSTRACT

An integral box component for a container including paperboard center and side sheets spaced apart and secured to a primary base sheet of paperboard and covered with bottom and top layers of paper wrap material to seal the paperboard sheets against moisture. The method comprises forming the center and side sheets and securing them to the primary base sheet and then securing the top and bottom wrapping papers thereto. Other auxiliary steps are employed to form a completed box component.

21 Claims, 6 Drawing Figures

CONTAINER AND METHOD OF MAKING A CONTAINER WITH INTEGRAL BOTTOM PANEL AND SIDE PANELS

FIELD OF THE INVENTION

The present invention relates to a novel product and method for making containers used for packaging and shipping fruit products and the like, and more particularly, it is directed to an integral box component for such containers having a bottom panel and two side panels integrally formed as one component for assembly into a complete container having end panels and a cover. The present invention is also directed to a novel method of making such a box component having optimum strength and flexibility in its folding sections.

BACKGROUND OF THE INVENTION

Containers for the packaging and shipping of fruit and the like, such as grapes, are well known in the art. In the past, such containers or boxes used for this purpose, and their covers, have been made of wood, since wooden containers have sufficient strength to withstand being stacked and to also withstand storage in a humid environment. Typically, the wooden covers have wooden cleats at the ends thereof for attaching the wooden covers to the wooden end panels of the boxes, In addition, shipping containers used in the past have also been formed from fiberboard material and corrugated paperboard material. Such fiberboard and paperboard boxes have been impregnated with varius materials to protect them. Still further, other shipping containers have been formed from slats of wooden material covered and held together with paper, as shown, for example, in U.S. Pat. No. 3,905,478.

Although a number of different constructions have been utilized in the past to provide an inexpensive and practical container for this purpose, none of those which have been developed thus far have proved to be entirely satisfactory for the storage and shipping of fruit and the like, such as grapes, in a humid environment. For example, prior constructions employing paperboard, fiberboard, or corrugated material all have the drawback of having very little, if any moisture resistance and thus are susceptible to losing their strength and rigidity. Such drawbacks were partially overcome by containers formed on wooden slats and covered with paper. However, because the bottom panel is formed of two or more separate wooden slats which are held together by paper, such a bottom panel has a tendency to bend and/or deform when subjected to the weight of the contents of the container. Moreover, there are no wooden slats in the folding sections of such boxes, and such folding sections are formed only from the paper holding the slats together. Thus, the folding sections have no support or rigidity in such boxes. In addition, typcially such boxes do not have dimensional stability in that the wooden slats are not uniform in size. Further, the wooden slats have a tendency to split during use and also cause splinters. Also, it is difficult to print product information on such shipping containers because the wooden slats and spaces between them create an uneven printing surface. Still further, wooden boxes cannot be recycled after use, although paperboard boxes can be.

Integral box components utilizing complete paperboard constructions also have had drawbacks. For example, the folding sections were formed only from wrapping paper and had no supporting paperboard sheets. Thus, the folding sections had a tendency to crease and collapse and did not have sufficient strength and rigidity.

Broadly, it is an object of the present invention to provide an improved integral box component for the packaging and shipping of fruit and other products which overcomes one or more of the aforesaid drawbacks, has greater strength, rigidity and stability than prior art constructions, is recyclable, and is moisture resistant.

It is a further object of the present invention to provide an integral box component for a container which includes in one unit the bottom panel, side panels and folding panels, and which is ready to be assembled with end panels and a cover to form a complete bo, so that the integral box component of the present invention may be shipped in a flat configuration, which substantially reduces shipping and storage costs for such containers.

It is a still further object of the present invention to provide an intergal box component for a container having as its primary structural member or "backbone" a base sheet of paperboard material which extends through the bottom panel, folding panels and side panels, so that the folding sections have more supprot and strength which contributes to the overall rigidity of the box.

It is a still further object to provide strong folding sections which include creasing scores to facilitate proper folding and alignment of the folding sections relative to the end panels.

SUMMARY OF THE INVENTION

Briefly, in accordance with the principles of the present invention, there is provided an improved integral box component having a bottom panel, a pair of side panels, and a pair of folding panels therebetween, all formed as a single integral unit for assembly with end panels and a cover to form a completed box or container. The integral unit includes a primary base sheet or "backbone" of water resistant paperboard material to which are secured a center sheet and two spaced-apart side sheets of paperboard material which form, respectively, the bottom and side panels of the completed box component. A sheet of bottom wrap material is provided to cover the bottom surface of the primary base sheet of paperboard material and extends around the aligned edges of the primary sheet and the side sheets and covers portions of the top surfaces of the side sheets. In addition, a sheet of top wrap material is provided to cover the top surfaces of the center sheet and the two side sheets.

Between the center sheet and side sheets are two folding sections which, together with the top and bottom wrap materials, form first and second folding panels. Longitudinally-extending creasing scores are provided in the folding panels to facilitate folding and alignment of the folding panels with the end panels during assembly.

The present invention is also directed to an improved method of forming the integral box component or unitary construction of the present invention. The method comprises the steps of laminating layers of water resistant paperboard material to form one or more laminated sheets of paperboard material which are continuously supplied to a work station. At the work station, the paperboard material is slit along two longitudinally-extending and spaced-apart lines to form the central section and to form the first and second side sections. The central section and side sections are suitably spaced apart from each other to provide first and second longitudinally-extending spaces which will form the folding panels of the completed box. A primary base sheet of water resistant paperboard material is then secured to the coplanar center section and side sections. Then, a sheet of bottom wrap material is applied to cover the bottom surface of the primary paperboard sheet and extends around the outer longitudinal edges of the primary sheet and the first and second side sheets. In addition, a sheet of top wrap material is applied to cover the upper surfaces of the central section and two side sections.

The folding panels are provided with ventilation holes and are scored to provide longitudinal creases to facilitate folding.

At this point in the method, the integrally-wrapped sections of paperboard material are slit transversely at spaced apart points to form an integral box component of the desired length. Then, the transversely-extending edges of the integral box component are coated with a suitable waterproofing material, such as liquid plastic, to seal such transverse edges against the absorption of moisture and humidity.

Advantageously, as a result of the present invention, an improved integral and unitary box component is formed which may be assembled with end panels and a cover to form a complete shipping and packaging container. Such an integral box component has the advantages of increased strength, rigidity, and stability because of the "backbone" of the primary base sheet of paperboard material to which the central and side sheets are secured. This also provides flexible but strong folding panels for the box component.

The integral box component also has dimensional stability, since the bottom and side panels are uniform in length. Also, it provides the advantage of a smooth surface on which to print necessary product information. Not only does the present invention provide an improved product of increased strength, but the present invention also provies an improved method of continuously forming integral box components from continuously supplied sheets of paperboard material, and wrapping or covering material. Such a process substantially reduces the cost of manufacturing integral box components, yet provides boxes of increased strength and dimensional stability.

Further objects, features, and advantages of the present invention will become apparent upon the consideration of the detailed description of the presently-preferred embodiments when taken in conjunction with the accompanying drawings, wherein.

DETAILED DESCRIPTION OF THE PREFERRED EMBODIMENT

Figure 1:
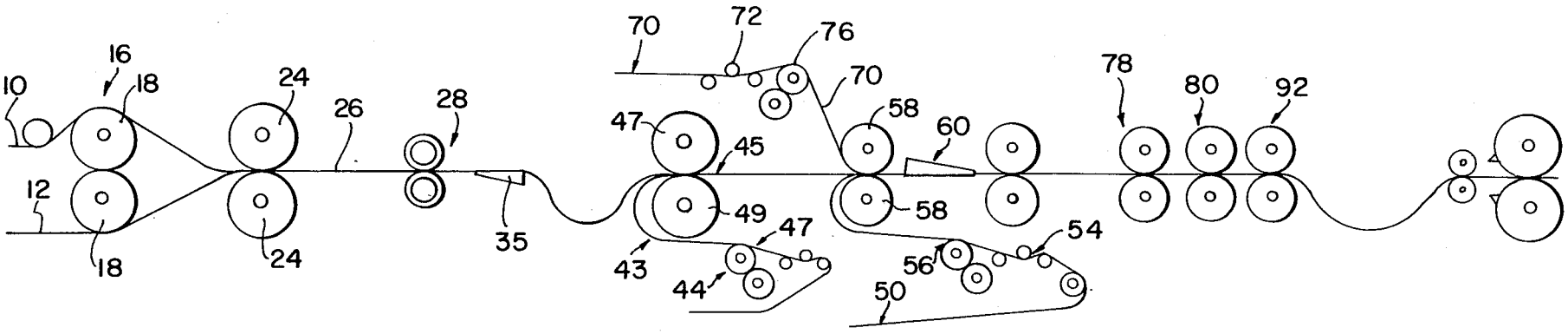
FIG. 1 is an elevational view of the various steps in forming the integral box component of the present invention.

Referring now to FIG. 1, there is illustrated the steps in the method of manufacturing the improved integral box component of the present invention. More particularly, as shown in FIG. 1, individual layers of paperboard material 10 and 12 are supplied from a continuous supply of paperboard material (not shown) to a gluing station 16 which includes a suitable number of gluing rollers 18 which apply waterproof adhesive, such as polyvinyl alcohol to the individual layers 10 and 12 of paperboard material. The individual layers are then supplied to a set of pinch rollers 24, so that the individual layers of paperboard material are glued together to form a single sheet of adhered paperboard material 26 as it leaves pinch rollers 24. The individual layers 10 and 12 of paperboard material may be of any desired thickness to provide the required strength. For example, in the packaging of fruit, such as grapes, it is desirable that each of the individual layers 10 and 12 be formed of paperboard material having a thickness of 40 to 60 points, so that the sheet 26 of paperboard material has a thickness of approximately 120 points. Somewhat thinner material may be used, if desired, because of other components which are secured to sheet 26. Also, the paperboard material is first treated with a water-resistant agent, such as rosin size, which is added while the paperboard is being made. sufficient sizing is added to provide a maximum of 3.5 grams of water pickup according to T.A.P.P.I. test number T491.

Figure 2:
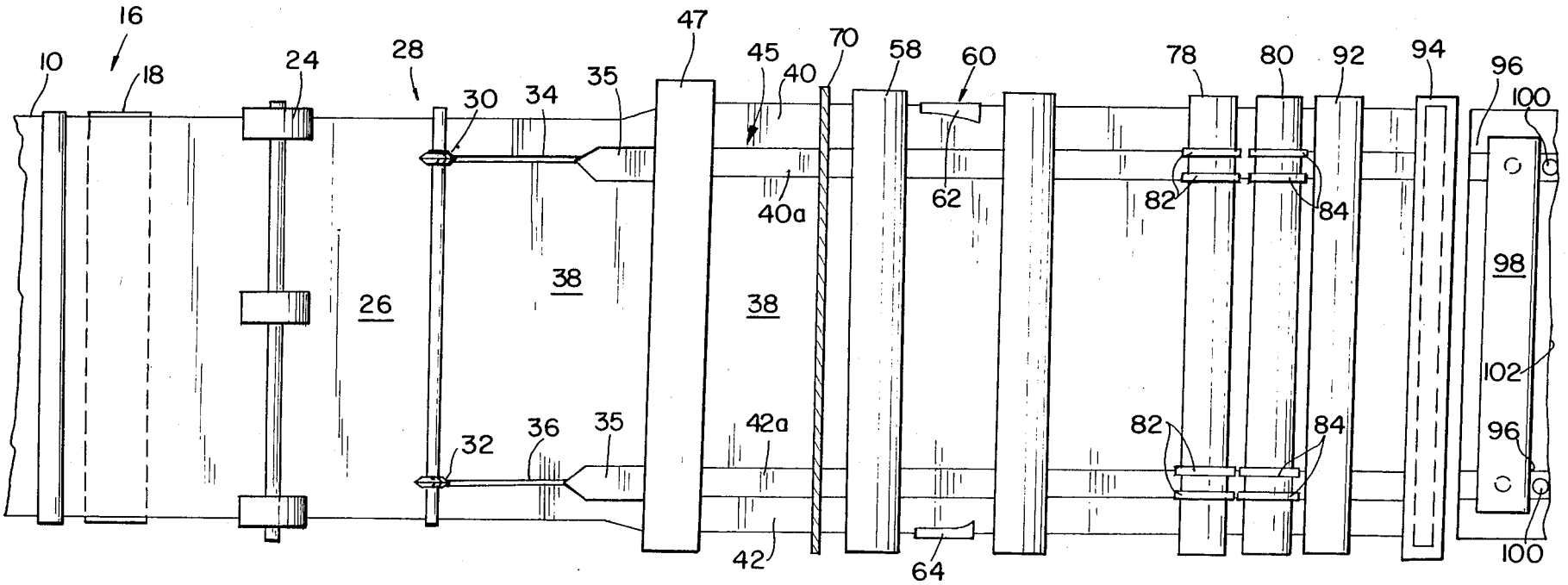
FIG. 2 is a plan view of the apparatus shown in FIG. 1.

Next, the sheet 26 of paperboard material is supplied to a slitting station 28, and as will be noted in FIG. 2, the slitting station 28 includes spaced-apart cutters 30 and 32 for forming longitudinal slits 34 and 36 in sheet 26 as it passes through slitting station 28. In this manner, the sheet 26 of paperboard material is divided into three spaced-apart coplanar sheets or sections, which include a center sheet or section 38 and two side sheets or sections 40 and 42. As will be seen hereinafter, they become portions of the bottom panel and the side panels, respectively, of the integral box component of the present invention. Suitable spacer means are provided after the slitting station, for example wedges 35, to space apart the central sheet 38 and the side sheets 40 and 42 a suitable distance to form the folding sections of the integral box component, in a manner to be explained. The wedges 35 form spaces 40*a* and 42*a* which are maintained while the sheets 38, 40 and 42 are supplied to subsequent processing stations and apparatus.

Next, a primary base sheet 43 of paperboard material having the same width as the width of the area defined by the spaced-apart sheets 38, 40 and 42, is fed from a supply station to a gluing station 44 at which waterproof adhesive is applied to its upper surface. Sheet 43 is then guided along with the sheets 38, 40 and 42 between heavy press rolls 47 and 49 to adhere the primary base sheet 43 to the three separate sheets to form a strong unitary paperboard assembly 45.

The paperboard assembly 45 thus formed is then supplied to bottom and top wrapping stations for covering the bottom and upper surfaces thereof with suitable material, such as Kraft paper, liner paper, or vinyl material, having a waterproof capability. As shown in FIG. 1, a roll of such paper or bottom wrap material is shown at 50 and is supplied through a plurality of bar guides 54 to a gluing station 56 which applies waterproof adhesive to one surface of the bottom wrapping material. Bottom wrapping material 50 is slightly wider than paperboard assembly 45 and as it passes through rubber rolls 58, it is adhered to the bottom or lower surface of primary paperboard sheet 43.

As will be noted in FIG. 1, a roll 70 of top wrap material is continuously supplied through bar guides 72 to a gluing station 76 for applying waterproof adhesive to the undersurface of wrap material 70. Top wrap material 70 is adhered to the upper surfaces of paperboard sections 38, 40 and 42 by suitable rollers at roller station 58. The width of top wrap material 70 may be slightly less than the total width of the area defined by spaced-apart sheets 38, 40 and 42.

Figure 4:
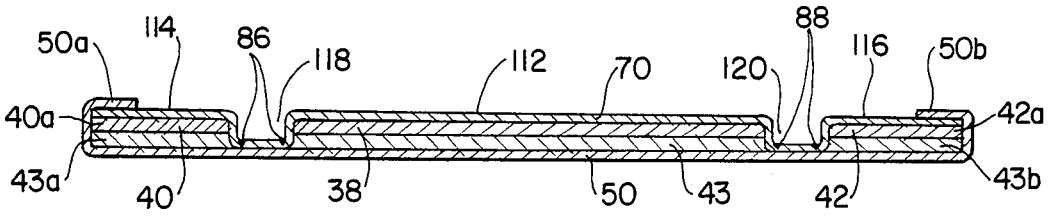
FIG. 4 is a sectional view along the lines 4—4 in FIG. 3.

After wrapping paper 50 and 70 and paperboard assembly 45 are adhered to each other, they are supplied to a folding station 60 which includes folding elements 62 and 64, as shown in FIG. 2, which operate to fold and wrap the edges of wrap material 50, shown at 50*a* and 50*b* in FIG. 4, about the longitudinally-extending aligned edges 43*a* and 43*b* of primary sheet 43 and edges 40*a* and 42*a*, respectively, of side sheets 40 and 42. The portions 50*a* and 50*b* of wrap material are of sufficient width to cover and be glued to portions of the upper surfaces of the side sheets 40 and 42 or to the upper surface of top wrap 70. Accordingly, as sheet 43 and wrap material 50 pass through wrapping or turning elements 62 and 64, edge portions 50*a* and 50*b* are folded over to cover the upper surface of paperboard sheets 40 and 42 along its edges with the wrap material, as shown at 40*a* and 42*a*. Just before this step, the upper surfaces of the paperboard sheets in sections 38, 40 and 42 are covered with top wrapping material 70. in this particular embodiment, wrap materials 50 and 70 have a thickness in the preferred range of 10 to 18 points, but as will be understood, the thickness can be varied for the desired purpose.

Next, the paperboard sections 38, 40 and 42 and the layers of wrap material 50 and 70, which are now integrally connected, are suppplied to roller station 78 having rubber wheels 82 formed thereon, which are in line with the longitudinally-extending spaces 40*a* and 42*a*, respectively. As the integral layers pass roller station 78, the rubber wheels 82 engage the upper wrap material 70 and press it into engagement with the primary sheet 43 in the spaces 40*a* and 42*a* between the sheets 38, 40 and 42. These spaces 40*a* and 42*a* become the longitudinally-extending folding sections or folding panels 118 and 120 of the completed box component shown in FIG. 3.

Figure 5:
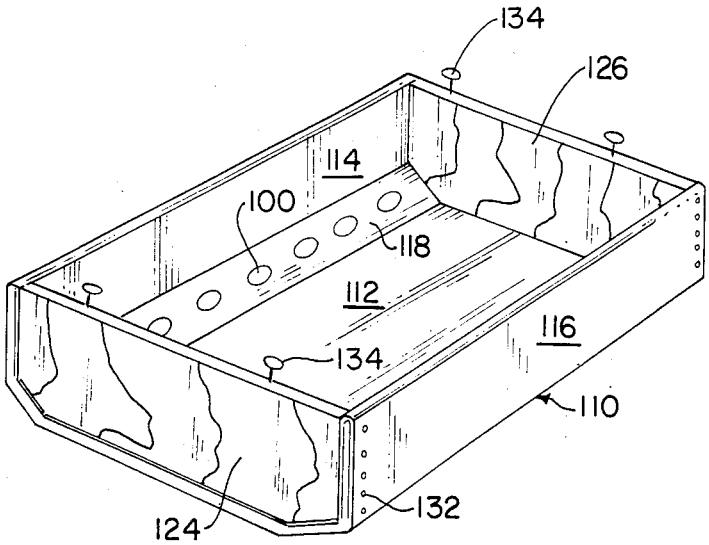
FIG. 5 is a perspective view illustrating the integral box component after it has been folded and attached to two wooden end panels.

As the integral layers move along, they come to roller station 80 having 2 pairs of scoring wheels 84 formed thereon for applying creasing scores 86 and 88 to each of the folding panels 118 and 120, respectively, Such creasing scores 86 and 88 facilitate folding and proper alignment of the folding panels 118 and 120 with the end panels 124 and 126 as shown in FIG. 5.

Referring again to FIG. 2, the above described integral layers are pulled by pulling rollers 92 to a transverse slitter 94 for transversely slitting the integral layers to form sheets of desired length. For example, typical for such box components are lengths of 17½ inches, but as will be understood, such sheets may be cut transversely to form sheets of any desired length.

Next, sheets 96 which have been transversely cut to the desired length are supplied to a work station 98, partially shown in FIGS. 1 and 2 which, in one operation, prints necessary product information on one surface of each sheet 96. In addition, at the same time, sheet 96 is die cut to form large ventilation holes 100 (FIG. 3) along the longitudinally-extending folding panels 118 and 120 which are sufficiently wide to receive large ventilation holes. Finally, the transversely cut edges 102 are coated with suitable waterproofing material, such as liquid plastic, to seal such transverse edges against moisture and humidity.

Figure 3:
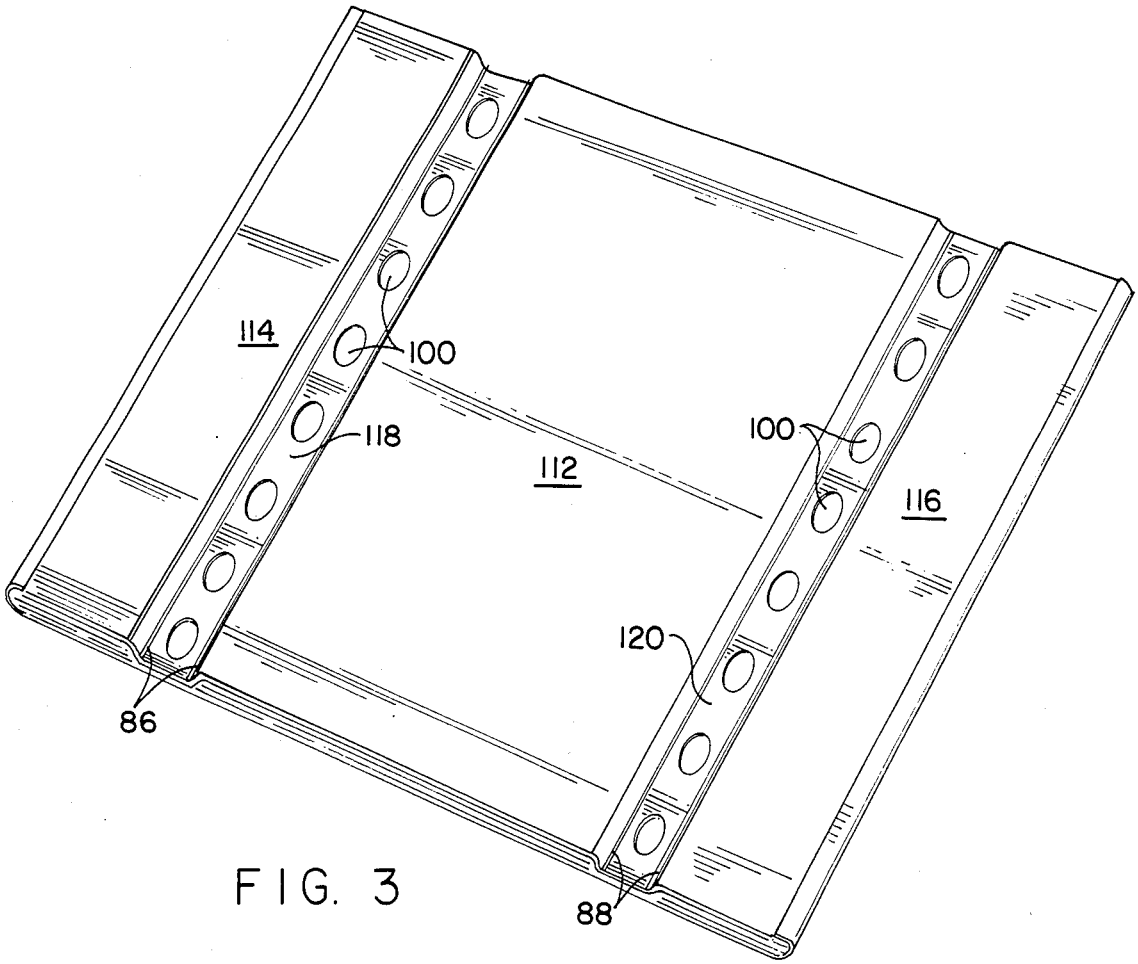
FIG. 3 is a perspective view of the integral box component of the present invention in a flat configuration before the side panels are folded upwardly relative to the bottom panel.

The completed integral box component 110 of the present invention is shown in FIGS. 3 and 4. As will be noted, central section 38, together with a portion of base sheet 43 and a portion of the top and bottom wrap, forms bottom panel 112. Side section 40, together with a portion of sheet 43 and a portion of the top and bottom wrap, forms side panel 114. Side section 42, together with a portion of sheet 43 and a portion of the top and bottom wrap, forms side panel 116.

As will be understood, side panels 114 and 116 are adapted to be folded upwardly relative to bottom panel 112 about longitudinal-folding panels 118 and 120. As will be seen in FIG. 5, in this folded position, end panels 124 and 126 are placed between side panels 114 and 116 and are nailed or otherwise attached to the bottom panel 112 and side panels 114 and 116. In addition, a suitable cover 130 is applied to the container after it has been filled with fruit or the like, such as grapes, for storage and shipping. The end panels are typically formed of wood, and the cover may be nailed or otherwise attached to the upper surfaces of the end panels to complete the assembly of the shipping container.

The cross-sectional view in FIG. 4 of the box component 110 shows the primary base sheet 43 of paperboard having a top surface 46 and a bottom surface 48. The center section 38 and the two side sections 40 and 42 are glued to the top surface 46 of the primary sheet 43. The sections 38, 40 and 42 are spaced apart and oriented so that the outer edges 40*a* and 42*a* of sheets 40 and 42 overlie and are coextensive with the edges 43*a* and 43*b*, respectively, of the primary sheet 43. The primary sheet 43 is as wide as the width of the area covered by the three sheets 38, 40 and 42. The bottom wrap 50 is secured to and extends along the lower surface of the primary sheet 43 and wraps around the aligned and coextensive edges of the base sheet 43 and of the side sheets 40 and 42 and covers a portion of the top surfaces of each of the two side sheets with its edge portions 50*a* and 50*b*. Top wrap sheet 70 overlies the three sections 38, 40 and 42 and the folding sections therebetween.

Figure 6:
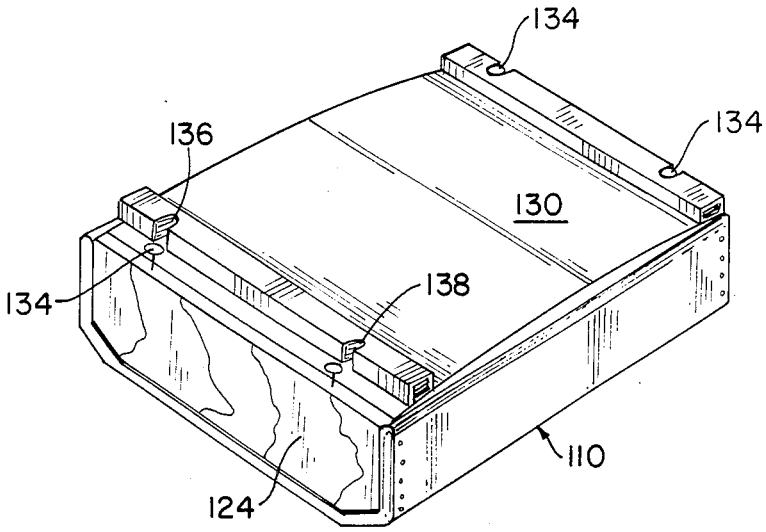
FIG. 6 is a perspective view illustrating a paperboard lid being flexed and applied to a box formed in accordance with the present invention.
Figure 3:
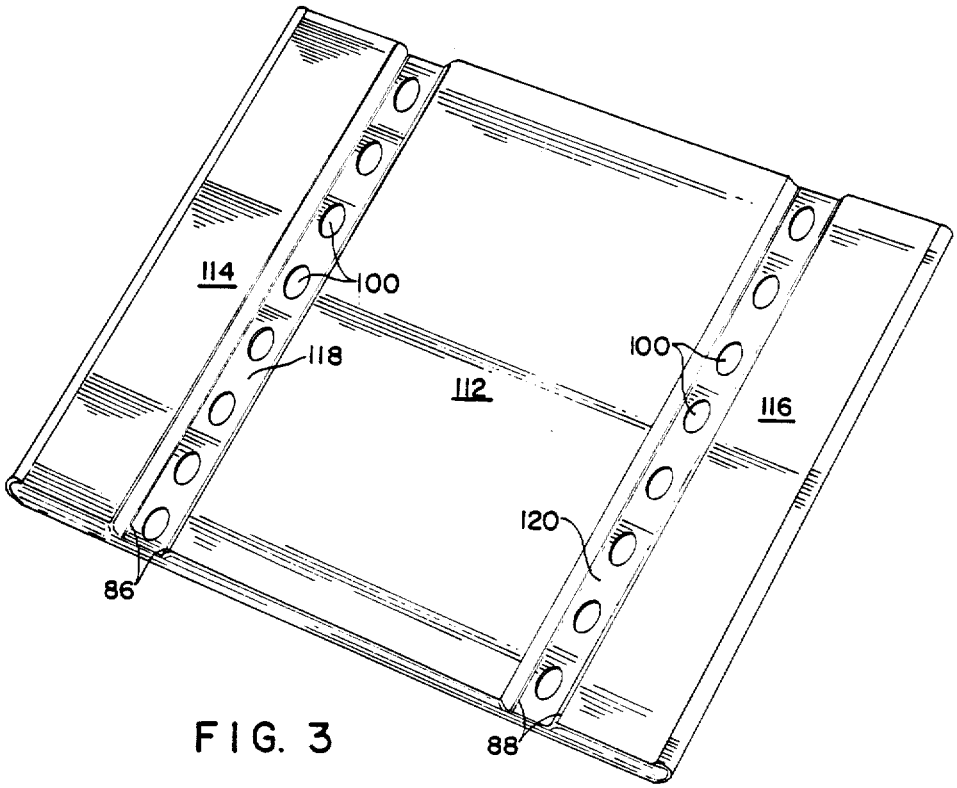
Figure 4:
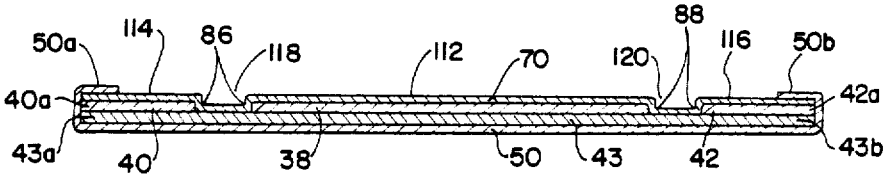

Referring now to FIGS. 5 and 6, there is shown the integral box component 110, formed in accordance with the present invention, which is nailed by a plurality of nails 132 to end wooden panels 124 and 126 to form the lower part of the container. In addition, nails 134 are placed within the upper surface of the wooden end panels 124 and 126 so that they are adapted to receive the paperboard lid 130. Lid 130 is flexed so that the nail holes 136 and 138 are adapted to be slid into engagement with nails 134 on the end panels.

In the manner, the box and cover are completely assembled and ready to be shipped with the grapes and/or other fruit contained therein. It will be appreciated that there has been provided in accordance with the present invention a paperboard box component 110 which are simple and inexpensive to manufacture in a continuous process, and which can be shipped in a flat configuration at a reduced cost. In addition, at the point of use, the box component 110 is easily assembled with the wooden end panels 124 and 126. Also, at the point of use, the paperboard lid may be easily and quickly applied to the box. Finally, as the entire lid and the integral box 10 component 110 are made from paperboard and paper material, they can be recycled after use.

In view of the foregoing, it will be noted that there has been provided in accordance with the present invention an improved product and method of forming the product. More particulary, since the method of the present invention provides a continuous process for forming the integral box component 110, it is relatively inexpensive. In addition, because each of the panels 112, 114, 116, 118, and 120 include a continuous primary base sheet of paperboard material 43 extending through all the panels, each panel is strong and less prone to bending than prior art arrangements. In addition, since the folding panels 118 and 120 include the primary paperboard sheet and the top and bottom wrapping layers, they are stronger and provide more support and rigidity than prior art arrangements. Further, the present invention provides increased dimensional stability, since each of the panels is uniform in size. Still further, the completed integral box component 110 provides a smooth surface for printing thereon, which is important in high-speed operation.

A latitude of modification, change, and substitution is intended in the foregoing disclosure, and in some instances, some features of the invention will be employed without a corresponding use of other features. For example, the folded sections may be held together by staples of other fastening means, such as glue, hot melt adhesive, or contact adhesive, instead of by cohesive material, as described. In addition, sheets referred to as single sheets may be of multiple sheets or plies. Accordingly, it is appropriate that the appended claims be construed broadly and in a manner consistent with the spirit and scope of the invention herein.

What is claimed is:

1. An integral box component for use in assembling a box having a bottom panel, and first and second side panels, said box component comprising:

a primary base sheet of water-resistant paperboard material having a top surface, a bottom surface, and first and second longitudinally-extending outer edges;

three separate sections of water-resistant paperboard material adhered to the top surface of said primary sheet to define a center section and first and second side sections spaced apart from said center section, the outer longitudinal edges of said first and second side sections being substantially co-extensive with said first and second outer longitudinal edges of said primary base sheet;

a first folding section between said center section and said first side section and a second folding section between said center section and said second side sheet;

a sheet of bottom wrap protective material covering the bottom surface of said primary base sheet and wrapped around the co-extensive outer edges of said primary base sheet and said side sections and overlying portions of the top surface of each of said first and second side sections;

a sheet of top wrap protective material covering the top surfaces of said center section and said first and second side sections and covering the top surface of said primary base sheet in said first and second folding sections;

said bottom wrap, said top wrap, and said primary base sheet in said first folding section cooperating to define a rigid first folding panel and said bottom wrap, said top wrap and said primary base sheet in said second folding section cooperating to define a rigid second folding panel; and ventilation holes formed along the length of said first and second folding panels.

2. The integral box component in accordance with claim 1, wherein each of said first and second folding panels include longitudinally-extending creasing scores to facilitate folding of said first and second folding panels relative to said center section.

3. The integral box component in accordance with claim 1, wherein said water-resistant paperboard material includes a rosin size.

4. The integral box component in accordance with claim 1, wherein said bottom wrap and top wrap materials are formed of vinyl or paper material.

5. The integral box component in accordance with claim 1, wherein said bottom wrap material overlaps and is adhered to said top wrap material.

6. The integral box component in accordance with claim 1, wherein said three separate sections each include at least two sheets of paperboard material formed from a plurality of layers of paperboard material.

7. The integral box component in accordance with claim 1, having transversely-extending edges covred with a waterproofing material to seal same against the absorption of moisture and humidity.

8. The integral box component in accordance with claim 1, wherein said top and bottom wrap materials are formed of Kraft paper.

9. The integral box component in accordance with claim 1, wherein said top and bottom wrap materials are treated with water-resistant agents.

10. The integral box component in accordance with claim 1, wherein said center section and said first and second side sections are each comprised of at least one sheet of paperboard material formed from a plurality of layers of paperboard material.

11. A method of forming an integral box component for a box having a bottom panel and first and second side panels, said method including the steps of:

providing a relatively thick sheet of water-resistant paperboard material;

longitudinally slitting said sheet of paperboard material to provide three separate sheets spaced from each other to define a center sheet and first and second side sheets spaced apart and coplanar with said center sheet;

adhering a relatively thick primary base sheet of water-resistant paperboard material to the bottom surfaces of said center sheet and said spaced-apart side sheets, said base sheet having a sufficient thickness to impart strength and relative rigidity to the assembly formed with said center and side sheets;

adhering a first sheet of wrapping to the bottom surface of said base sheet and extending around the outer co-extensive edges of said base sheet and said first and second side sheets;

adhering a second sheet of wrapping material to the top surfaces of said center sheet and said side sheets and to said base sheet in the spaces between said center sheet and said side sheets; and said base sheet and said center sheet cooperating to form a bottom panel, said base sheet and said side sheets cooperating to form side panels, and said base sheet and said first and second wrapping sheets cooperating to form folding panels between said bottom panel and said side panels.

12. A method in accordance with claim 11, further including the step of forming a series of ventilation holes within said first and second folding panels.

13. A method in accordance with claim 11, further including the step of forming longitudinally-extending creasing scores in said first and second folding panels to faciliatate folding of said folding panels.

14. A method in accordance with claim 11, wherein said center sheet and said side sheets are adhered to said base sheet by a waterproof adhesive, such as polyvinyl alcohol.

15. A method in accordance with claim 1, further including the step of coating the transversely-extending edges of said integral box component with a weatherproofing material to seal same against the absorption of moisture and humidity.

16. A method in accordance with claim 11, wherein said center sheet and said side sheets each include at least two sheets of paperboard material for increased rigidity.

17. A method in accordance with claim 11, wherein the step of adhering said sheets of bottom and top wrap material includes the step of employing a waterproof adhesive, such as polyvinyl alcohol.

18. A method in accordance with claim 11, further including the steps of folding said side panels relative to said bottom panel and securing end panels thereto to form a box.

19. A method in accordance with claim 11, wherein the step of longitudinally slitting includes the step of spreading said center sheet and said side sheets apart a distance to form folding sections therebetween.

20. A method in accordance with claim 11, further including the steps of wrapping said first sheet of wrapping paper around the outer co-extensive edges of said base sheet and said side sheets and overlapping portions of the top surfaces of said side sheets.

21. A method in accordance with claim 11, further including the step of transversely slitting said assembly of sheets and wrapping paper to form said integral box component.

* * * * *

UNITED STATES PATENT AND TRADEMARK OFFICE

CERTIFICATE OF CORRECTION

PATENT NO. : 4,685,610

DATED : August 11, 1987

INVENTOR(S) : Leewood C. Carter; Robin P. Neary

It is certified that error appears in the above-identified patent and that said Letters Patent is hereby corrected as shown below:

Column 1, line 31, change "varius" to --various--.

Column 2, line 16, change "bo," to --box,--.

Column 2, line 26, change "supprot" to --support--.

Column 6, line 65, change "the" to --this-- at the first occurrence.

IN THE CLAIMS:

Column 8, line 33, change "covred" to --covered--.

IN THE DRAWINGS:

Delete Figures 3 and 4, and replace them with new Figures 3 and 4.

Signed and Sealed this

Seventeenth Day of May, 1988

*Attest:*

*Attesting Officer*

DONALD J. QUIGG

*Commissioner of Patents and Trademarks*